US007055441B2

(12) United States Patent
Jarvis

(10) Patent No.: US 7,055,441 B2
(45) Date of Patent: Jun. 6, 2006

(54) COUNTERBALANCED DECK FOR RAILROAD FREIGHT CAR

(75) Inventor: James J. Jarvis, Portland, OR (US)

(73) Assignee: Gunderson, Inc., Portland, OR (US)

( * ) Notice: Subject to any disclaimer, the term of this patent is extended or adjusted under 35 U.S.C. 154(b) by 0 days.

(21) Appl. No.: 10/401,153

(22) Filed: Mar. 27, 2003

(65) Prior Publication Data

US 2004/0187730 A1 Sep. 30, 2004

(51) Int. Cl.
*B61D 17/00* (2006.01)

(52) U.S. Cl. ..... 105/404

(58) Field of Classification Search ..... 105/396, 105/404, 409, 410, 238.1, 355, 375, 377.05
See application file for complete search history.

(56) References Cited

U.S. PATENT DOCUMENTS

| | | | | |
|---|---|---|---|---|
| 1,965,525 | A | 7/1934 | Roscher et al. | 105/368 |
| 2,066,714 | A | 1/1937 | Butterworth | 105/368 |
| 2,137,979 | A | 11/1938 | Cooper | 105/368 |
| 2,164,662 | A | 7/1939 | Nampa | 105/368 |
| 2,647,009 | A | 7/1953 | Huebshman | 296/1 |
| 3,139,371 | A | 6/1964 | Sisko | 161/37 |
| 3,230,900 | A | 1/1966 | Ruprecht et al. | 105/368 |
| 3,405,661 | A | 10/1968 | Erickson et al. | 105/371 |
| 3,646,627 | A | 3/1972 | Potter | 14/71 |
| 3,927,621 | A | 12/1975 | Skeltis et al. | 105/368 R |
| 3,977,123 | A | 8/1976 | Clay, Jr. et al. | 49/102 |
| 4,019,442 | A | 4/1977 | Lee et al. | 105/376 |
| 4,059,055 | A | 11/1977 | Ravani et al. | 105/368 R |
| 4,119,042 | A | 10/1978 | Naves et al. | 105/368 R |
| 4,119,043 | A | 10/1978 | Naves et al. | 105/368 R |
| 4,119,750 | A | 10/1978 | Porter | 428/105 |
| 4,149,472 | A | 4/1979 | Naves et al. | 105/368 R |
| 4,238,168 | A | 12/1980 | Naves | 410/27 |
| 4,248,557 | A | 2/1981 | Roldness et al. | 410/27 |
| 4,271,649 | A | 6/1981 | Belanger | 52/309.2 |
| 4,428,993 | A | 1/1984 | Kohn et al. | 428/117 |
| 4,759,669 | A | 7/1988 | Robertson et al. | 410/29 |
| 4,787,669 | A | 11/1988 | Wante | 296/182 |
| 4,801,229 | A | 1/1989 | Hanada et al. | 410/26 |
| 4,801,483 | A | 1/1989 | Beckerman et al. | 428/71 |
| 5,100,730 | A | 3/1992 | Lambers | 428/402 |
| 5,462,623 | A | 10/1995 | Day | 156/250 |
| 5,589,243 | A | 12/1996 | Day | 428/56 |
| 5,622,115 | A | 4/1997 | Ehrlich et al. | 105/3 |
| 5,676,507 | A | 10/1997 | Lugo | 410/29.1 |
| 5,685,228 | A | 11/1997 | Ehrlich et al. | 105/370 |

(Continued)

FOREIGN PATENT DOCUMENTS

WO WO 00/10804 3/2000

*Primary Examiner*—S. Joseph Morano
*Assistant Examiner*—Robert J. McCarry, Jr.
(74) *Attorney, Agent, or Firm*—Chernoff Vilhauer McClung & Stenzel, LLP

(57) ABSTRACT

A railroad car includes a body having a pair of side walls and at least a pair of parallel horizontal support beams extending along the side walls at substantially the same height. A movable end portion of a deck built as a lightweight composite structure may pivot with respect to the pair of support beams. A respective counterbalance apparatus is arranged between each of the pair of side walls and the movable deck portion at a location spaced apart from the pivot axis so as to provide a lifting force acting on the movable end portion to urge it to pivot upward about the pivot axis.

18 Claims, 11 Drawing Sheets

U.S. PATENT DOCUMENTS 5,730,485 A 3/1998 Sjostedt et al. ..... 296/182
5,743,192 A * 4/1998 Saxton et al. ..... 105/355
5,794,537 A 8/1998 Zaerr et al. ..... 105/4.1
5,834,082 A 11/1998 Day ..... 428/56
5,890,435 A 4/1999 Thoman et al. ..... 105/404
5,928,735 A 7/1999 Padmanabhan et al. ..... 428/33
5,979,335 A 11/1999 Saxton et al. ..... 105/404
6,138,580 A * 10/2000 Thoman ..... 105/396
6,179,942 B1 1/2001 Padmanabhan ..... 156/153
6,183,824 B1 2/2001 Padmanabhan et al. ..... 428/33
6,325,579 B1 12/2001 Jarvis ..... 410/26
6,368,035 B1 4/2002 Recupido et al. ..... 410/26

* cited by examiner

COUNTERBALANCED DECK FOR RAILROAD FREIGHT CAR

BACKGROUND OF THE INVENTION

The present invention relates to railroad freight cars and in particular to a freight car for carrying motor vehicles on multiple levels.

Railroad freight cars have long been used for transporting newly manufactured automobiles long distances from either the place of manufacture or a port of arrival to a place where the automobiles are reloaded onto trucks that deliver the automobiles to dealerships. In order for such railroad freight cars to be most economical it is desirable to carry a maximum number of motor vehicles on each railroad car, but it is also desired to be able to carry several different types of motor vehicles on each car and to be able to reconfigure the railroad freight car to carry such different types of vehicles without undue difficulty.

U.S. Pat. Nos. 5,743,192, 5,794,537 and 5,979,335, the specifications of which are incorporated herein by reference, are owned by the assignee of the present invention and each discloses a multi-unit railroad freight car for carrying motor vehicles on multiple levels. In each of the disclosed freight cars, a plurality of motor vehicle decks are spaced apart inside the respective car bodies, wherein the decks are adjustable in height.

Each end portion of the middle level deck in each unit of the cars disclosed in the mentioned patents is mounted on a pivot axis at its inner end so that the outer end portion of the deck, located at the end of the car unit, may be raised and lowered to facilitate the loading and unloading of vehicles on the lowest level of the car. A cable and a hand-driven winch system are used to raise and lower the hinged portion of the deck. The deck is heavy, and many operators have difficulty raising and lowering it with only a manually operated mechanical winch.

It is therefore desired to be able to raise the end of the deck without having to rely on the hand-cranked winch system, using the limited amount of available space within such a railcar, while keeping the weight of the car as low as practical.

What is needed, then, is an improved railroad freight car in which a movable end portion of a load-carrying deck is of ample load-bearing strength, yet lower in weight than previously used decks, and wherein such a movable portion is arranged to be raised and lowered directly.

SUMMARY OF THE INVENTION

The present invention overcomes the aforementioned shortcomings of prior art railroad cars for carrying motor vehicles on multiple levels and meets the aforementioned needs by providing an improved car body including a motor vehicle deck spaced upwardly above a lowest load carrying floor, and provides a movable end portion of such a deck which is significantly lighter in weight than previously known movable end portions for such railroad freight cars.

In a preferred embodiment of the invention, one or more deck-supporting counterbalance mechanisms, each including a spring, are arranged to partially support the weight of the movable end portion as it is being raised or lowered. The disclosed counterbalance mechanism has an elongate tension-carrying member coupled to the movable end portion of the deck for applying a lifting force from a spring to enable the movable end portion of the deck to be raised with mere hand pressure. The lifting force provided by the counterbalance mechanism assists the persons raising the movable end portion of the deck by carrying most of its weight as it is moved between its raised and lowered positions.

In a preferred embodiment of this aspect of the invention, the counterbalance mechanism for a movable end portion of a deck is arranged adjacent the end post of the sidewall of the car unit body, with the spring and its associated guide tube occupying interior space between the vertical support posts for the side wall of the railroad car body.

In a preferred embodiment of the invention, the movable end portion of a deck is of a lightweight composite sandwich construction with top and bottom skins of fiber reinforced plastic resin and with a core of low density material.

In one preferred embodiment of the present invention, such a lightweight sandwich deck structure has a core including transversely extending vertical arrays of fiber reinforced plastic and diagonal arrays of fiber-reinforced plastic resin strands or rods interconnecting the vertical arrays with each other and with the top and bottom skins.

In a preferred embodiment, the deck has a shape that provides ample strength for supporting motor vehicles, but also provides ample space to accommodate motor vehicles of various heights that the car is intended to carry.

In an embodiment of the invention, a lightweight deck of composite sandwich-like construction includes a longitudinally extending central portion with a significantly greater depth than that of adjacent side portions, on which the tires of motor vehicles rest when the motor vehicle straddles the center portion.

It is one feature of the lightweight deck according to the present invention that a significant majority of the reinforcing fibers included in the skins extend in a transverse direction with respect to the deck.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
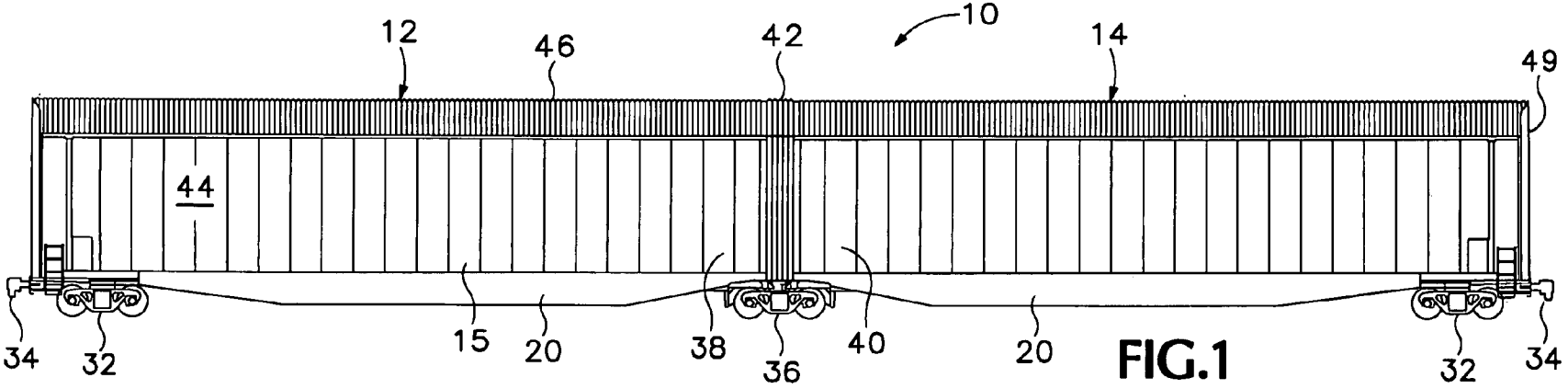
FIG. 1 is a side elevational view of a multi-unit railroad freight car incorporating one preferred embodiment of the present invention.
Figure 2:
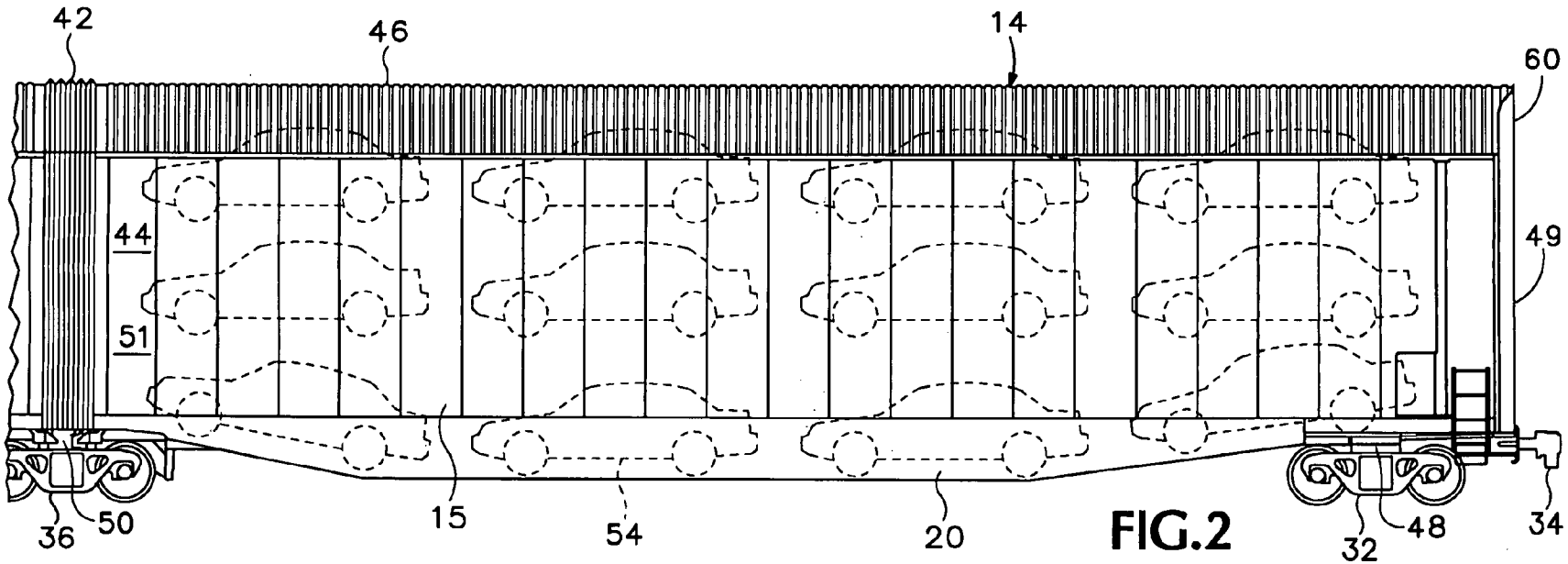
FIG. 2 is a side elevational view of one car unit and a part of the other unit of the car shown in FIG. 1, at an enlarged scale.

Referring to the drawings, which form a part of the disclosure herein, FIGS. 1–4 show a multi-unit railroad freight car 10 that incorporates one preferred embodiment of the present invention. The freight car 10 includes two adjacent car units 12 and 14. Each respective car unit 12 and 14, in turn, includes a cargo well 20, a middle deck 16, and an upper deck 18 for selectively supporting and storing automobiles in a tri-level arrangement as shown in FIG. 2. The cargo well 20, the middle deck 16, and the upper deck 18 are sometimes referred to as the "A", "B", and "C" decks, respectively. Each deck 16, 18, and 20 preferably has a shape that provides ample strength for supporting motor vehicles, while providing sufficient space to accommodate motor vehicles of the various heights that the car is desired to carry.

Figure 3:
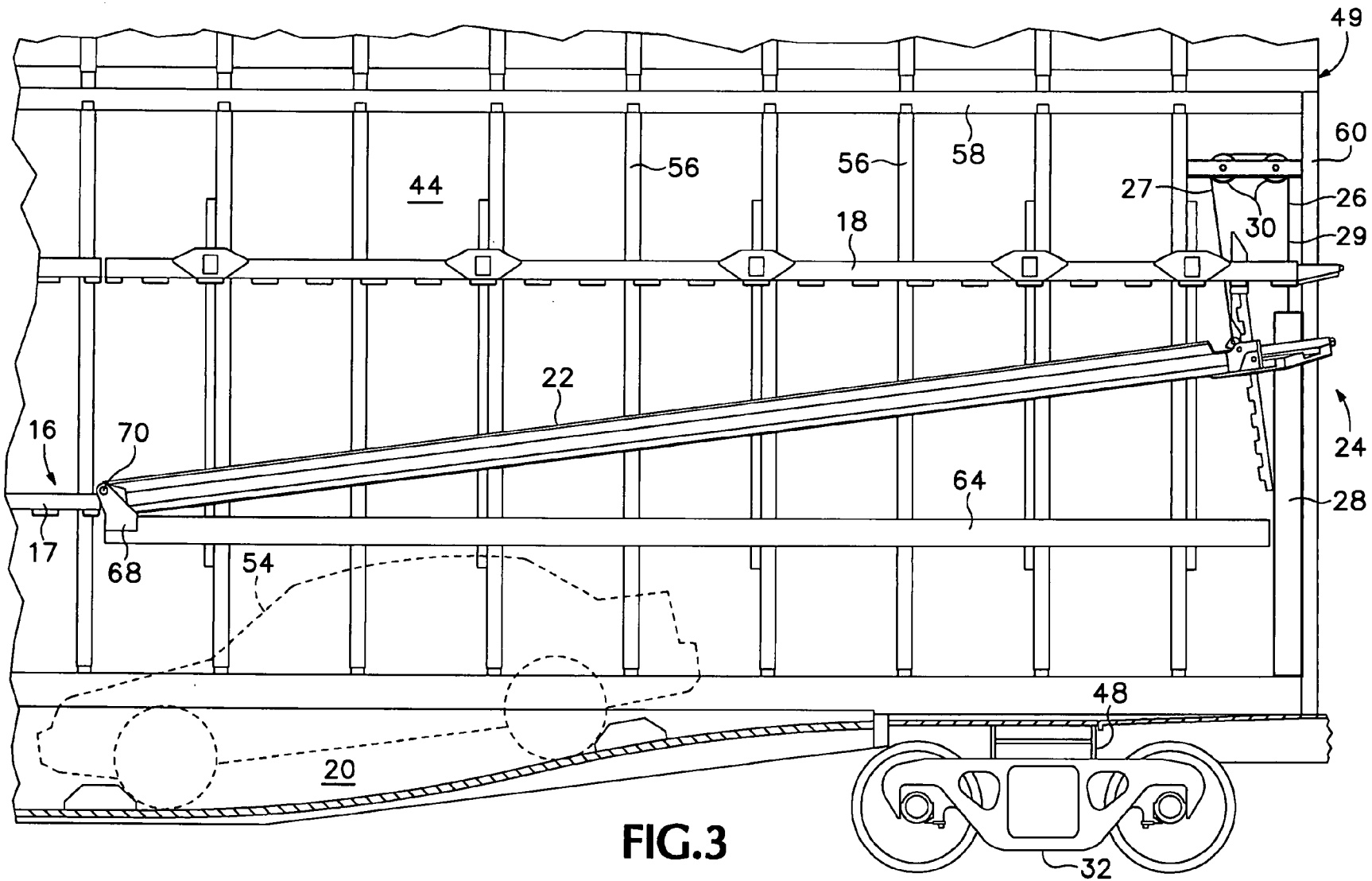
FIG. 3 is a cutaway side elevational view of a portion of one unit of the multi-unit railroad freight car shown in FIG. 1 showing the motor vehicle-carrying decks of the car body with a movable end portion of one of the motor-vehicle-carrying decks in an upwardly inclined position.

As can be seen in FIGS. 2–3, the automobiles stored on the lowest level of the freight car 10 rest in the respective cargo well 20 of each car unit 12 and 14. In order to maximize the available vertical space in the upper two cargo levels, the middle deck 16 is positioned such that it would prevent the loading and unloading of automobiles from the cargo well 20 were it not for a hinged end portion 22 of the middle deck 16 that may be selectively raised when automobiles are loaded or unloaded from the cargo well 20. Though FIG. 2 depicts only car unit 14 and FIG. 3 only depicts a portion of car unit 14, it is to be understood that each of the car units 12 and 14 has a middle deck 16 and an upper deck 18, and that the middle deck 16 in each car unit may include a hinged end portion 22 at either or both ends.

Because of the loads that they must support, the middle deck 16 and the upper deck 18 must be of sturdy construction and therefore the weight of the hinged end portion in previously existing railroad freight cars can be significant, making it impossible to raise and lower the hinged end portion by hand. The disclosed freight car 10, though, improves over such previously existing rail cars in two distinct respects.

First, the freight car 10 includes a hinged end portion 22 of a novel, lightweight composite construction having a core of low density material and a skin of fiber reinforced plastic resin adhered to the core of low density material. The skin of fiber reinforced plastic resin provides tensile and compressive strength to the compositely constructed hinged end portion 22 while the core of low density material provides shear strength to the compositely constructed hinged end portion 22. Further, by constructing the hinged end portion 22 using a core of low density material, the weight of the hinged end portion 22 can be made substantially less than that of corresponding hinged end portions in existing freight cars.

Second, the freight car 10 includes a novel counterbalance apparatus 24 that may support most of the weight of the hinged end portion 22. Together with the lightweight construction of the hinged end portion 22, the counterbalance apparatus 24 allows the hinged end portion 22 to be raised manually.

Preferably, the core of low density material is completely enclosed by the skin of fiber reinforced plastic. This ensures that the hinged end portion 22 has sufficient strength on both its upper and lower surfaces to accommodate the significant stress that occurs as vehicles are loaded and carried upon the hinged end portion 22. Preferably, a significant majority—around 70%—of the reinforcing fibers within the skin of fiber-reinforcing material may be oriented in a transverse direction with respect to the middle deck 16 to provide the strength required to withstand the expected static and dynamic loading of hinged end portion 22.

Also, the core of low density material may preferably include upright-transverse vertical arrays of fiber-reinforced plastic and diagonal arrays of fiber-reinforced plastic resin strands or rods interconnecting the vertical arrays with each other.

Figure 4:
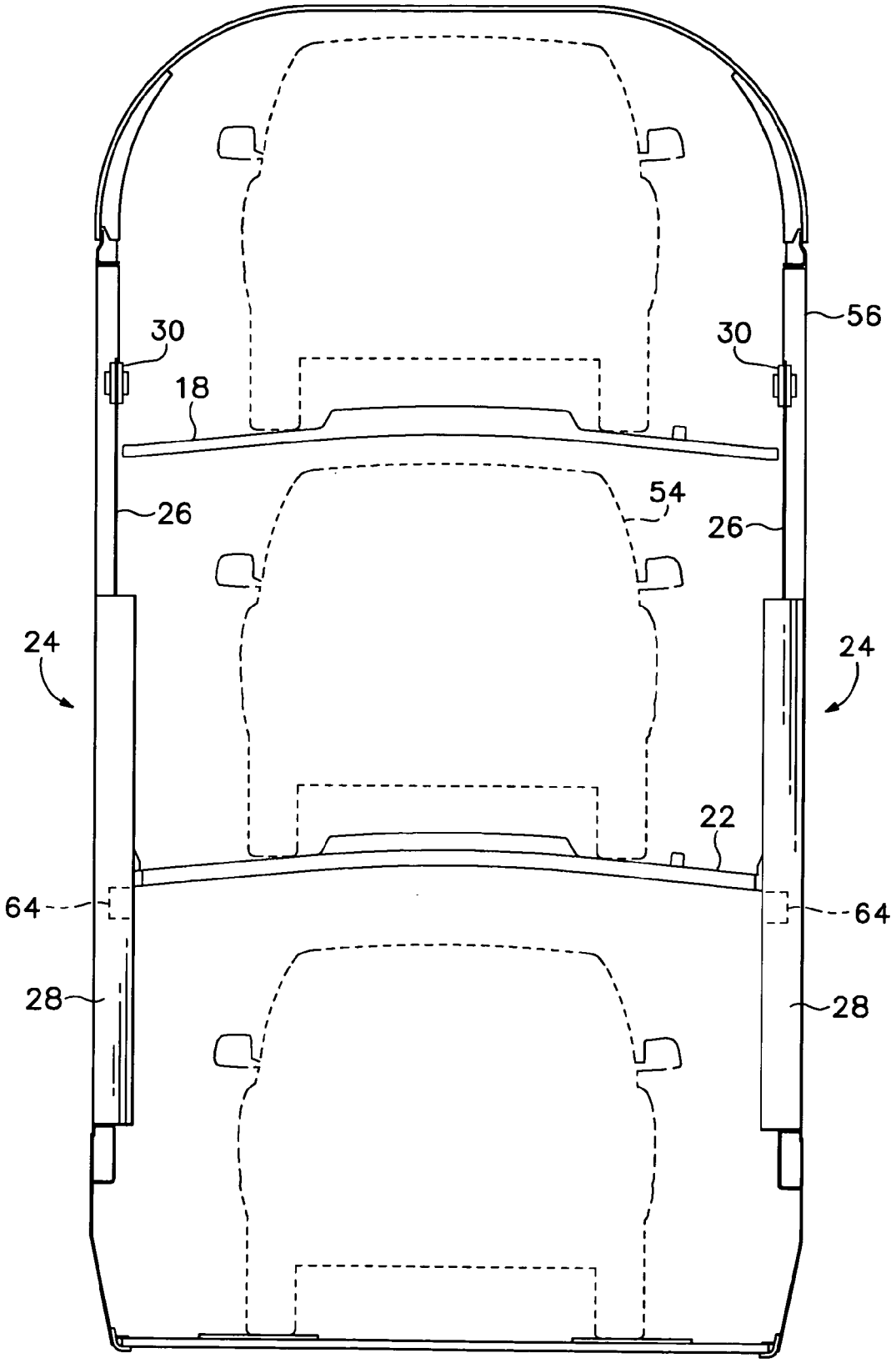
FIG. 4 is a cutaway end view of a car body of one unit of the multi-unit railroad freight car shown in FIG. 1 showing the locations of two units of an exemplary counterbalance apparatus that may be used with the present invention.

Broadly, each counterbalance apparatus 24 may include a force-transmitting member 26 such as a cable that interconnects and transmits forces between the hinged end portion 22 and a force-generating element 28 such as a spring 74. The force generating elements 28 will together preferably generate a force that is slightly less than the weight of the hinged end portion 22. Each force-transmitting member 26 may include a first elongate tension carrying member 27 operatively connected to, and extending upward from, the hinged end portion 22 and a second elongate tension carrying member 29 operatively interconnected with the force-generating element 28 such that tension in the first elongate tension carrying member 27 is caused by tension in the second elongate tension carrying member 29, which in turn is caused by the force-generating element 28. As can be seen in FIGS. 3 and 4, the counterbalance apparatus 24 is preferably located adjacent to a corner post 60 of the car body 15, with the force-generating element 28 occupying interior space between the corner post 60 and the nearest side post 56 along the side wall of the railroad car body 15.

In a simple embodiment, the force transmitting member 26 can be a cable and the force-generating element 28 can include a spring. In that instance, it may be appropriate to include a direction changing force transfer device, such as one or more sheaves 30. The direction changing force transfer devices may be positioned between the first elongate tension carrying member 27 and the second elongate tension carrying member 29. In more complex embodiments, an appropriate force transmitting member 26 could include gears, rigid members, etc.

Freight Car Construction

Referring to FIG. 1, the multi-unit railroad freight car 10 includes a pair of car units 12 and 14, with a conventional two-axle truck 32 and a coupler 34 at an outer, or coupler end of each of the car units 12 and 14. A shared truck 36 supports both of a pair of adjacent ends 38 and 40 of the car units 12 and 14, respectively. The adjacent ends 38 and 40 are interconnected with each other and with the shared truck 36 through an articulated coupling.

The car units 12 and 14 each have enclosed bodies with upright side walls 44 and roofs 46, and a flexible cover or diaphragm 42 interconnects the side walls 44 and roof 46 of the car unit 12 with those of the adjacent car unit 14.

Referring to FIGS. 2 and 3, the car unit 14, which is essentially identical to the car unit 12, includes a car body 15 whose structure includes a body bolster 48 at its coupler end 49, and a body bolster 50 at its opposite, or articulated end 51, supported by the previously-mentioned shared truck 36. The railroad car body 15 includes a side wall 44. While only one such side wall is shown in FIGS. 2 and 3, it should be understood that the opposite side of the railroad car has an essentially similar, but symmetrically opposite construction, as will be described herein with respect to the side wall 44. Automobiles, such as automobiles 54 (shown in phantom outline), are carried inside the railroad freight car 10. Only one such automobile 54 is shown in FIG. 3 and this automobile is stored inside the cargo well 20.

Decks 16 and 18 are provided above the cargo well 20 to support automobiles 54 in the car units 12 and 14 at multiple levels. Each deck may optionally be capable of adjustment to a selected one of several available heights in relation to the cargo well 20. The heights of decks 16 and 18 are suitably adjustable, as is explained for example, in U.S. Pat. No. 5,979,335, of which the disclosure is incorporated herein by reference. When adjustable, decks 16 and 18 may be moved to their respective heights independently of one another, or alternatively, the adjustable positioning of decks 16 and 18 may be coordinated, such that the upper deck 18 is moved to a lower position as the lower deck 16 is moved to a higher position and vice versa. In this latter arrangement, a freight car 10 may be loaded with automobiles of relatively small height on three levels, or loaded with automobiles of relatively large height after decks 16 and 18 are squeezed together, creating the required clearance in the cargo well 20 and above the upper deck 18, respectively.

The side walls 44 are preferably of welded sheet metal construction including upright side posts 56 in the form of flanged rolled channels, so that the side walls 44 are light, yet strong enough to support the weight of the decks 16 and 18 and the automobiles 54 carried thereon. A top chord 58 extending longitudinally of the car unit 14, between corner posts 60 located respectively at each end of the car unit 14, interconnects the upper ends of the side posts 56.

The decks 16 and 18 are both provided in the form of three segments arranged end-to-end, and, at any of the available heights, each of the segments is fastened securely and tightly to the side posts 56 by bolts or other releasable but tight fasteners so that the decks 16 and 18 are incorporated structurally in, and add rigidity to, the entire car unit 14 as well as being solidly supported by the side walls 44.

A hinged end portion 22 is included in each end of the middle deck 16 of each car unit 12 and 14. Preferably, those portions of the decks 16 and 18 other than the hinged end portions 22 of deck 16 are of steel construction, transversely arched to provide an upward camber. This structure allows the decks 16 and 18 to have a very small vertical depth so that a maximum vertical clearance is available for motor vehicles to be carried.

Hinges 68 pivotally attach the hinged end portion 22 to two horizontal support beams 64 that extend longitudinally along the opposite side walls 44 of the car at equal heights and that are rigidly fastened to the side walls 44 by bolts. Each of the horizontal support beams 64 extends inwardly from the side walls 44 so that when the hinged end portion 22 is in a lowered position, the hinged end portion 22 is supported along its lateral margins by the horizontal support beams 64. In this manner, the horizontal support beams 64 support that portion of the weight of the hinged end portion 22 and any motor vehicles or other cargo carried on the hinged end portion 22 that is not supported by the counterbalance apparatus 24. Each of the horizontal support beams 64 is positioned at a vertical height along its respective side wall 44 such that the hinged end portion abuts the fixed portion 17 of the middle deck 16 at a pivot axis 70 defined by the hinges 68 through which the inner end of the hinged end portion 22 is attached. The hinges 68 should preferably allow an outer end of the hinged end portion 22 of the middle deck 16 to be raised as much as about 4 feet to an inclined position above the horizontal support beams 64. Handles 136 may optionally be fastened to the hinged end portion 22 so that it may be raised and lowered manually. Raising the hinged end portion 22 of the middle deck 16 while deck 16 is empty allows automobiles to be moved over the two-axle trucks 32 and the body bolsters 48 and 50 into or out of the well 20 during loading and unloading of the freight car 10.

Construction of the Hinged End Portion

Figure 7:
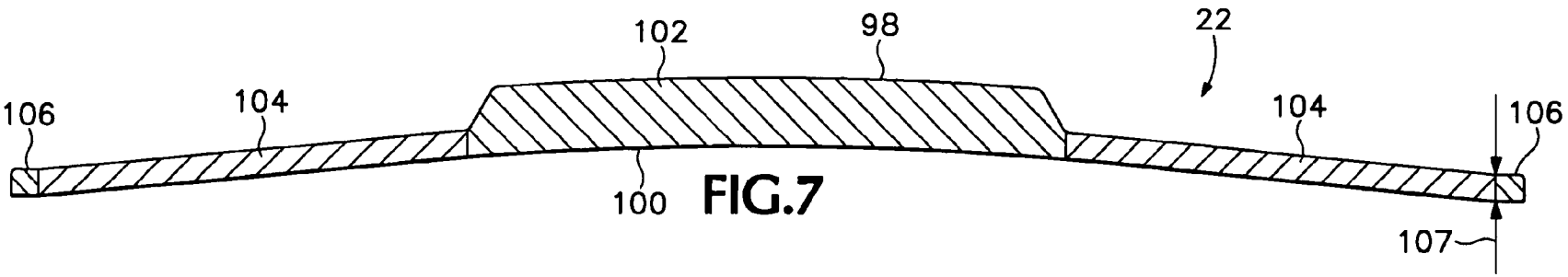
FIG. 7 is a sectional view taken along line 7—7 of FIG. 5.

Referring to FIGS. 5–10, the hinged end portion 22 may include a longitudinally extending central portion 102 and a pair of opposite side portions 104 that are located alongside the central portion 102 and extend laterally therefrom. The hinged end portion 22 is preferably constructed so as to have a generally convex upper surface 98 and a generally concave lower surface 100 as shown in FIGS. 4 and 7. This shape has been found to be generally suitable for the storage of automobiles for transport and corresponds to the typical shape of previously existing decks of freight cars.

The width of the central portion should preferably be no larger than can be straddled by automobiles. The lateral side portions 104 should taper to a minimum thickness 107 at their outer lateral edges, respectively. In the construction herein described, this minimum thickness 107 at the outer lateral edges of the lateral side portions is approximately 1.875 inches. The hinged end portion 22 is supported upon the horizontal support beams 64 at its outer lateral margins 106.

The hinged end portion 22 comprises a lightweight composite structure having a core of lightweight material and a skin of fiber reinforced plastic resin bonded to the core of lightweight material. The material that forms the core of the hinged end portion 22 preferably has a low density and has sufficient shear strength so that, when reinforced with skins of fiber-reinforced plastic resin, the hinged end portion 22 may durably withstand the loading stresses to which they will each be subjected over an extended period of use. Materials that may be suitable to form the core of any or all of these members include balsa or one of a variety of types of plastic foam core materials, preferably including a closed-cell synthetic plastic foam with suitable reinforcing structure incorporated, such as "Tycor B" foam core, which is commercially available from WebCore Technologies, Inc., of Dayton, Ohio.

Figure 8:
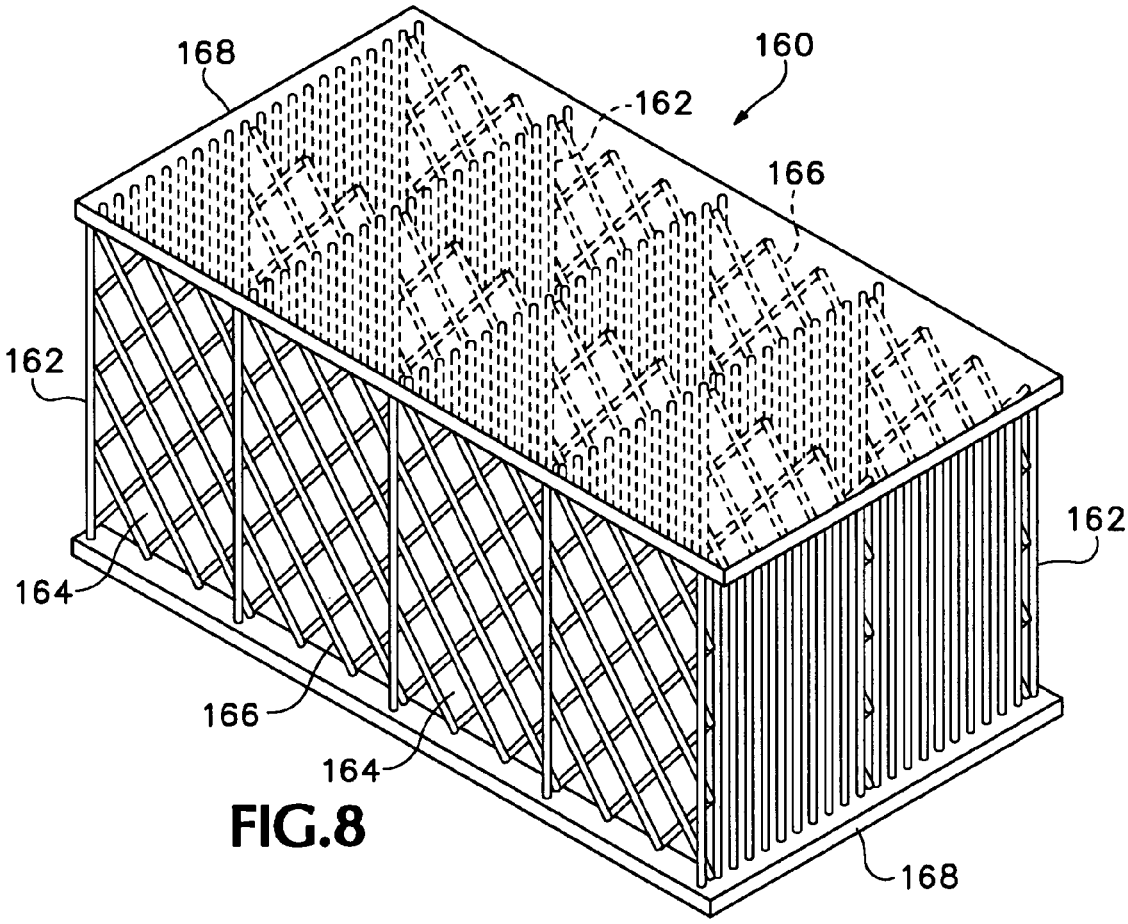
FIG. 8 is a perspective view of a block of a reinforced foam core material suitable for use as part of a composite deck structure in accordance with the present invention.

Referring to FIG. 8, the core of lightweight material of the hinged end portion 22 may comprise Tycor-B 13-weight foam core 160, where 13-weight indicates that the core has a density of 13 lbs/ft$^3$. The foam core 160 includes a parallel fiber array 162 that is vertically oriented within the foam core 160 and that partitions the foam core 160 into sections 164 of approximately equal width. The fiber array 162 is composed of strands of fibers, such as glass or carbon fibers.

The Tycor-B foam core further includes a diagonal fiber array 166, also composed of strands of glass or carbon fibers.

The core of the hinged end portion 22 may be made up of individual members that include a longitudinally extending central member 108, two longitudinally extending side members 109, a nose assembly 110, two side portion transition members 112, and a central portion transition member 114. The aforementioned transition members are shaped to conjoin the respective central and side portions of the hinged end portion 22 with the corresponding central and side portions of the lower deck 16. The nose assembly 110 comprises a nose 116 and insert members 118.

In the preferred construction, the central member 108, as well as the transition member 114, may each be shaped from a section of 4" thick Tycor B 13-weight foam core material 160. Each of the two side members 109, as well as the transition member 112, may be constructed of a 1⅝" thick section of Tycor B 13-weight foam core material. The nose 116 may be made from a section of 2" thick Tycor B 13-weight foam core material. The 4" thick foam core material 160 for the members 108 and 114 may be assembled by conjoining a 1⅝" thick section and a 2⅜" thick section of Tycor B foam core material, or may instead be constructed as a single 4" thick section of foam core material.

A skin 168 of fiber reinforced plastic that surrounds the core of the lightweight material may be formed through any appropriate method, such as a Vacuum Assisted Resin Transfer Molding (VARTM) process, which is well known in the industry. Other methods may also be used to form the skin 168, including such methods as RTM vacuum bagging. If the VARTM process is used to form the skin 168 of fiber reinforced plastic, one or more layers of reinforcing fiber are placed in a mold that corresponds to the shape of the top of the hinged end portion 22. The individual members of the core of the hinged end portion 22, such as 108, 109, 110, 112, and 114, are then appropriately positioned in an upside-down configuration on top of the layer or layers of reinforcing fiber within the mold. Then a second layer or layers of reinforcing fiber is positioned on top of the lower surface of the individual members of the hinged end portion 22. The assembly is then covered by a vacuum bag. Calculated quantities of resin and catalyst are mixed to form an appropriate quantity of liquid uncured plastic resin which is then drawn into the vacuum bag, which acts to evenly distribute the plastic resin throughout the layers of reinforcing fiber of the skin 168 and the reinforcing fiber strands of the foam core material, and to keep the resin in place while it cures.

Figure 5:
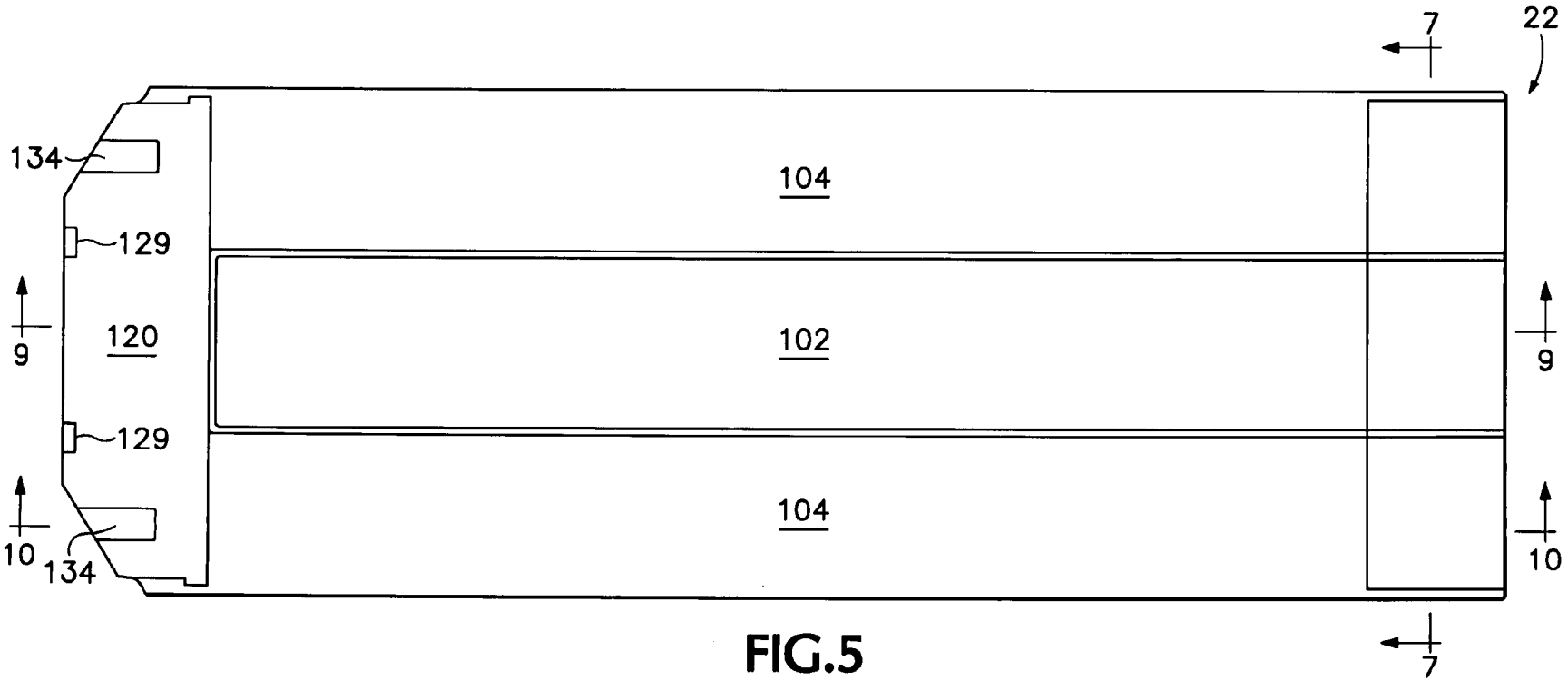
FIG. 5 is a top plan view of a movable end portion of a deck for a railroad freight car that embodies one aspect of the present invention.
Figure 6:
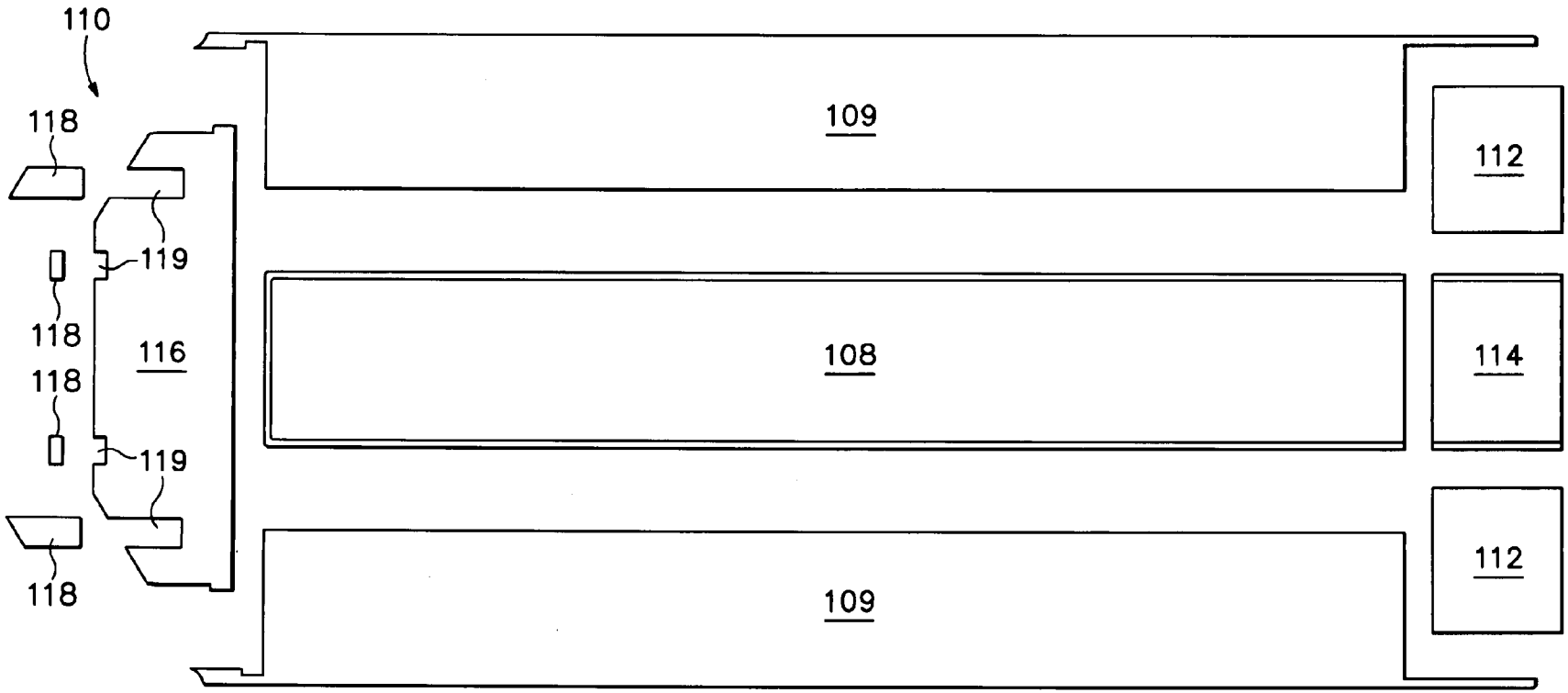
FIG. 6 is an exploded top plan view of the movable end portion of the deck shown in FIG. 5.
Figure 13:
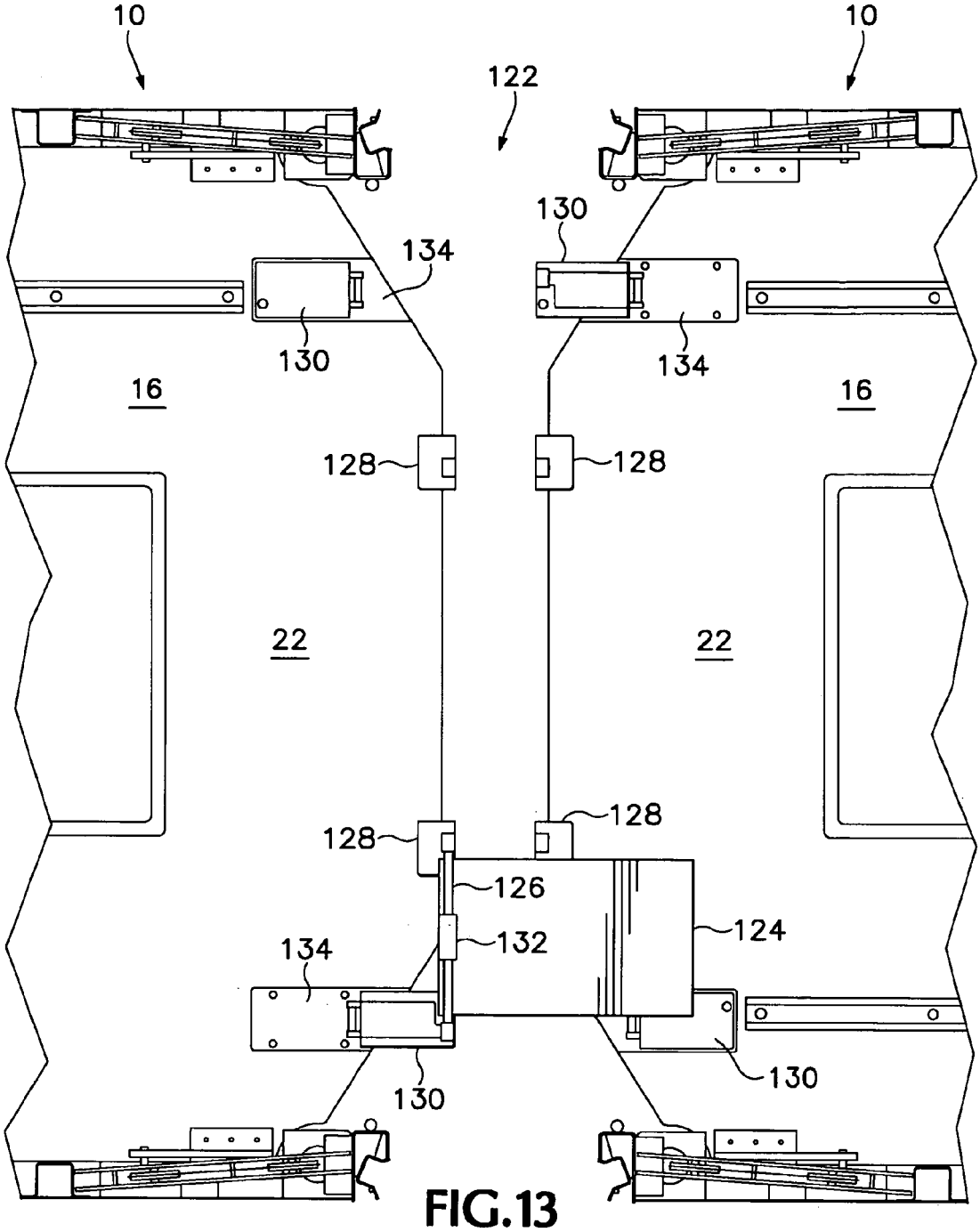
FIG. 13 is a view showing a bridge unit for coupler ends of freight cars that incorporate the present invention.

During the VARTM process, the fiber arrays 162 and 166 absorb some of the plastic resin, which is then cured along with the skin 168. Once infused with cured plastic resin, the fiber arrays 162 and 166 add strength to the core. Preferably, the foam core 160 is positioned so that the fiber array 162 is oriented upright-transverse with respect to the hinged end portion 122 and the fiber array 166 is oriented upright-longitudinal with respect to the hinged end portion 22.

Where a VARTM process is used to form the hinged end portion 22, the insert members 118 may be formed during that process by positioning five plies of resin-impregnated BTI 62 oz E-glass woven roving into the spaces 119, prior to the application of the skin 168 of fiber reinforced plastic that encloses the hinged end portion 22. Referring to FIGS. 5, 6, and 13, the insert members 118 form the base of the cavities 129 and 134 into which brackets 128 and 130 are positioned and attached to the hinged end portion 22.

Figure 9:
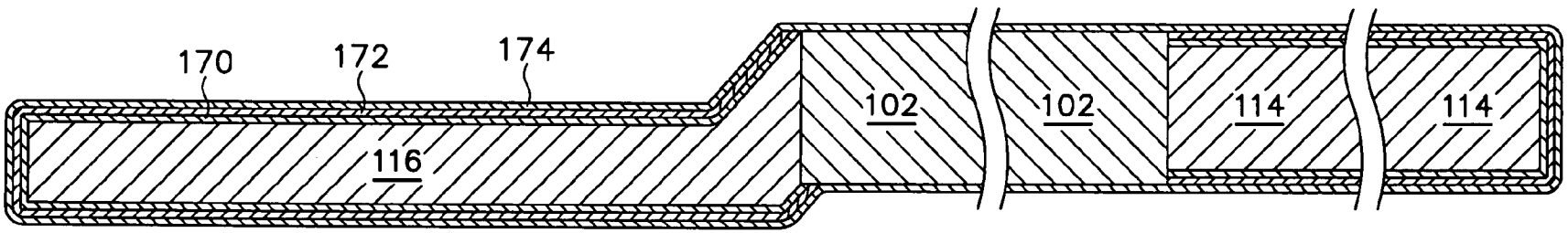
FIG. 9 is a sectional view taken along line 9—9 of FIG. 5.
Figure 10:
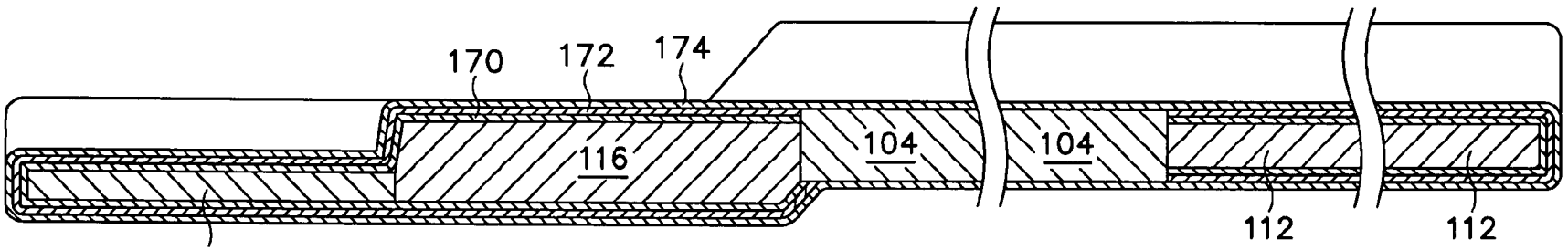
FIG. 10 is a sectional view taken along line 10—10 of FIG. 5.

In the preferred construction, the skin 168 may have a varying number of layers of fiber reinforced plastic surrounding different members of the hinged end portion 22. Referring to FIGS. 9 and 10, for example, the nose 116, the insert members 118, the central portion transition member 114, and the side portion transition members 112 are each surrounded by an inner layer 170 of two plies of resin-impregnated BTI 60 oz. E-Glass woven roving, a central layer 172 of 2-plies of 30 oz. E-Glass unidirectional, and an outer layer 174 of two plies of resin-impregnated BTI 62 oz. E-Glass woven roving. In contrast, the central portion 102 and the side portions 104 are surrounded only by the outer layer 174 of two plies of resin-impregnated BTI 62 oz. E-Glass woven roving. Preferably, the E-Glass woven roving in both of the inner layer 170 and the outer layer 174 has its warp oriented transversely to the deck. Further, an anti-skid compound may be selectively applied to regions of the assembly where desired. Rodda anti-skid epoxy W/#46 Aluminum oxide aggregate has been found to be suitable. Particular regions where an anti-skid compound is appropriate are the side members 109 and the transition member 112.

In the construction of the hinged end portion 22 shown in FIGS. 5–10 the portions of the skin 168 that surround the central portion transition member 114, the side portion transition members 112, and the nose assembly 120 have additional layers of reinforcing fiber and hence have a greater thickness than the other components of the hinged end portion 22. The locations of these additional layers of reinforcing fiber correspond to either the locations in the disclosed freight car 10 where wheels of loaded automobiles will be expected to create high stress, e.g. the transition member 112 and the nose 116, or locations where bolts or other fasteners are required to assemble the hinged end portion 22, e.g. the nose assembly 110 and specifically the insert members 118. The extra layers of reinforcing fiber provide the extra thickness and strength needed to support bolts or other fasteners. Further, by concentrating those additional layers of reinforcing fiber only in the particular locations where they are needed minimizes the weight of the hinged end portion 22 that must be counterbalanced by the counterbalance apparatus 24.

Another method of improving the strength of the hinged end portion 20 is to orient the layers of fiber reinforced plastic such that most of the fibers are oriented transversely to the longitudinal axis of the hinged end portion 22. In the freight car 10, the hinged end portion 22 extends from a pivot axis 70 at the junction with the middle deck 16 and is supported by the horizontal support beams 64 when the middle deck 16 is in a lowered position, as it would be when automobiles are loaded onto it. Thus the weight of the hinged end portion along with the weight of any automobiles on top of it during transport will create bending stress in the hinged end portion in the transverse direction. By orienting a majority of the fibers—around 70%—in the transverse direction, the hinged end portion is made better able to resist these stresses. In other embodiments, it may be preferable to orient the layers of fiber-reinforced plastic parallel to the longitudinal axis of the hinged end portion 22.

Structure of the Counterbalance Apparatus

Referring to FIG. 3, a counterbalance apparatus 24 is used to support most of the weight of the hinged end portion 22 so that it may be easily raised and lowered manually. The counterbalance apparatus 24 applies a lifting force from the force-generating element 28 to the outer end of the hinged end portion 22 through a force-transmitting member 26, which in this instance is a flexible 5/16" diameter steel lifting cable. Though FIG. 3 shows only one counterbalance apparatus, located adjacent to side wall 44, a symmetrically opposite counterbalance apparatus, shown in FIG. 4, is preferably located in a similar position on the opposite side of the freight car unit 14, adjacent the near side wall. The lifting cable 26 extends upward and around sheaves 30 which may be mounted in fixed locations, preferably between the corner post 60 and that side post 56 that is adjacent to the corner post 60 along the side wall 44 in the direction toward the mid-length of the car unit 14. The cable 26 operatively connects the hinged end portion 22 to the force-generating element 28.

Figure 11:
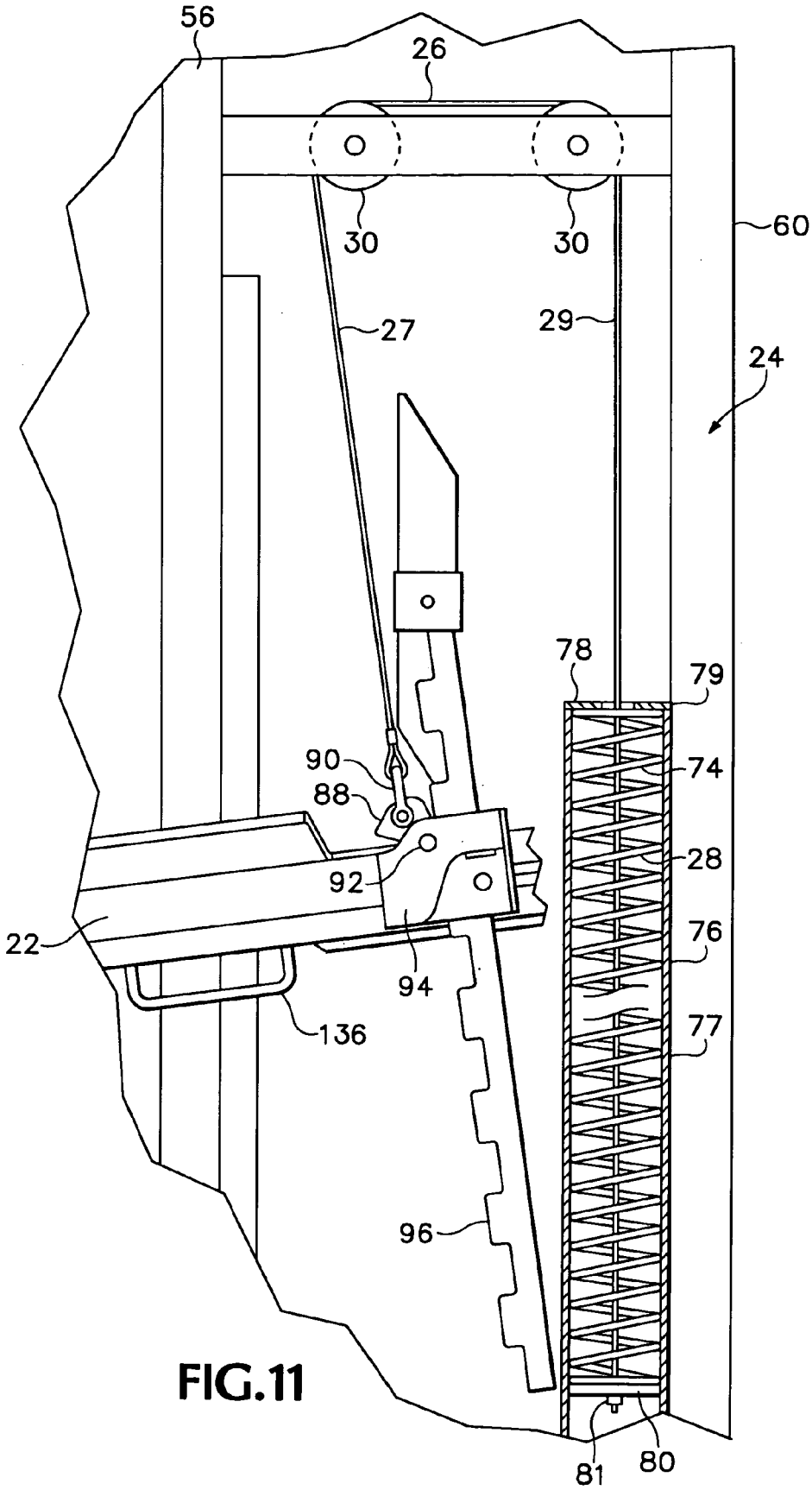
FIG. 11 is a detail view, at an enlarged scale, of the uppermost portion of one side wall of the body of one unit of the railroad car shown in FIG. 1, showing the location of sheaves for a cable supporting the movable deck portion at one end of the car body and also showing a counterbalancing support apparatus.

Referring to FIGS. 3 and 11, the force-generating element 28 preferably includes a generally helical compression spring 74 positioned in a vertically oriented guide tube assembly 76 so that the compression spring 74 is free to extend and be compressed. The compression spring 74 and the guide tube assembly 76 extend into an interior space that lies between the corner post 60 and the adjacent side post 56. In this way, the counterbalance apparatus 24 is situated in what is otherwise unused space inside the railroad car and does not interfere with any other structure or cargo inside the car. The guide tube assembly 76 comprises a cylindrical sleeve 77, an upper fitting 79 and a lower fitting (not shown) that together surround the compression spring 74. The cylindrical sleeve 77 is preferably made from, or at least lined with, a layer of polymeric resin such as UHMW polyethylene so that friction and wear may be minimized as the compression spring 74 oscillates across the inner surface of the sleeve 77. The upper fitting 79 defines an opening 78. The lifting cable 26 extends through the opening 78 and through the compression spring 74, and is secured to a plunger 80 that is slidably fitted within the sleeve 77 below the compression spring 74. In this manner, movement of the hinged end portion 22 can cause the plunger 80 to slide vertically within the sleeve 76. Movement of the plunger, in turn, compresses the compression spring 74 or allows it to extend downward, depending on the direction the plunger 80 is moving. The length of the cable 26 should be such that the compression spring 74 applies a lifting force to the hinged end portion 22 that is slightly less than that which would lift the outer end of the hinged end portion 22 when the hinged end portion 22 is in the lowered position. Furthermore, the compression spring 74 is preferably long relative to the distance through which a point on the cable 26 will oscillate when the hinged end portion 22 is raised or lowered, so that the lifting force supplied by the counterbalance apparatus 24 remains within a small range during raising and lowering of the hinged end portion 22. The hinged end portion 22 of the deck 16 can thus be raised easily during loading of motor vehicles into the cargo well 20 to provide ample overhead clearance above the body bolster 48 or 50 as motor vehicles pass over the truck 32 at each end of the multi-unit freight car 10 or over the shared truck 36 between car units 12 and 14.

Figure 12A:
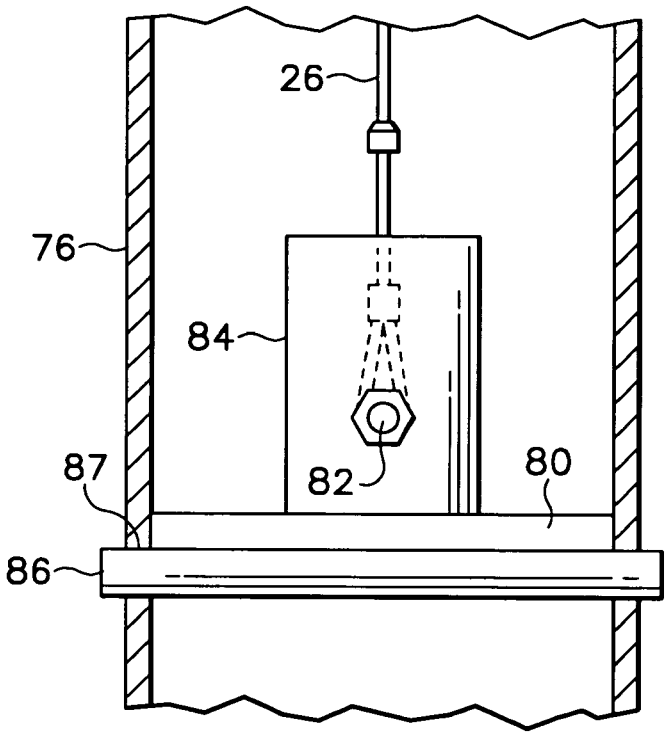
FIGS. 12A and 12B are views showing an alternate arrangement used to interconnect the cable shown in FIG. 11 to the spring included in the counterbalance arrangement.
Figure 12B:
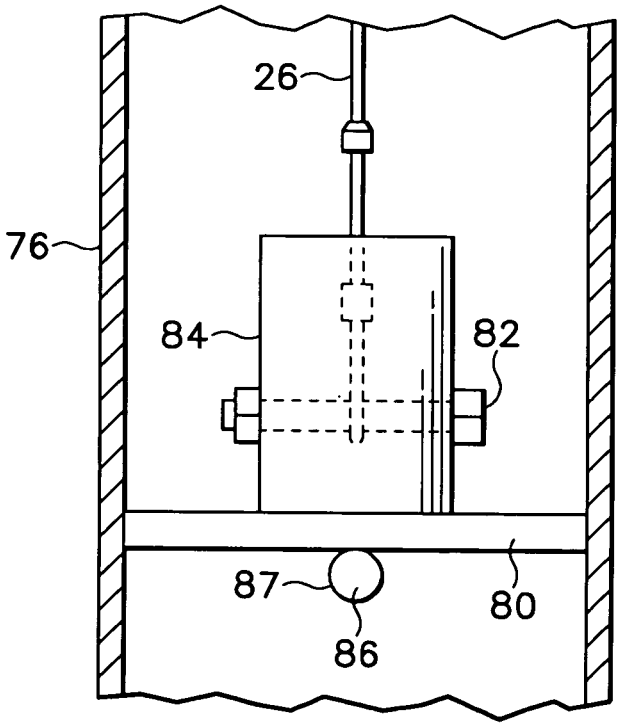

The cable 26 may be attached to the plunger 80 in any convenient manner. For example, FIG. 11 shows that the cable 26 passes through the plunger 80 and is secured to the plunger 80 at the lower surface of the plunger 80 using a swaged fitting 81. FIGS. 12A and 12B show an alternative arrangement of attaching the cable 26 to the plunger 80. In this arrangement an eye defined by the cable 26 is attached around a bolt 82 that passes through a short piece of pipe 84 or other rigid member that, in turn, is affixed to the upper surface of the plunger 80.

On occasion, it might be desired to remove the cable 26 from the hinged end portion 22. For example, the cable may need to be replaced, or it may be desired to squeeze the decks 16 and 18 together to provide space for carrying high-clearance vehicles on two levels. However, during normal operation of the hinged end portion 22 there will not typically be sufficient slack in the cable to remove it. Accordingly, the counterbalance apparatus 24 preferably includes a spring stop bar 86 that may be inserted into an opening 87 in the sleeve 76 located at a position just below that occupied by the plunger 80 when the hinged end portion 22 is in the lowered position. When the spring stop bar 86 is inserted in the opening 87 while the hinged end portion is in the lowered position, the spring stop bar 86 prevents the plunger 80 from moving downward as the hinged end portion 22 is raised. In this manner, sufficient slack may be created in the cable 26 so that it may be removed. Optionally, the sleeve 76 may include a second opening (not shown) near the bottom of the sleeve, below the point to which the plunger 80 will drop when the hinged end portion 22 is in the raised position. The spring stop bar 86 may be inserted into this second opening for storage when the cable 26 is attached to the hinged end portion 22.

Similarly, the cable 26 may be attached to the hinged end portion 22 of the middle deck 16 in any convenient manner. Preferably the cable 26 is attached to the hinged end portion 22 through a safety catch arrangement shown best in FIG. 11. The cable 26 is attached to a lever 88 through a shackle 90. The lever 88, in turn, is rotatably mounted to the hinged end portion 22 by a pin 92 that extends through holes in the sides of a bracket 94 affixed to the outer end of the hinged end portion 22. A spring (not shown) operatively engaged with the lever 88 will cause the lever 88 to engage a safety arm 96 so long as there is not a requisite amount of tension in the cable 26. In this manner, should the cable 26 unexpectedly break or otherwise fail during manual operation of the hinged end portion 22, the lever 88 will engage the safety arm 96 and support the hinged end portion 22, potentially avoiding injury.

Though FIG. 3 shows only one such hinged end portion 22 located at the outer end 49 of the car unit 14 in freight car 10, it should be recognized that each two-unit freight car 10 may ideally contain four such hinged end portions 22. Each car unit 12 and 14 in the freight car 10 may have a hinged end portion 22 at its outer or coupler end, i.e. the outer ends of the freight car. In addition, the freight car 10 may include a hinged end portion 22 at the articulated end, i.e. the inner end, of each of the car units 12 and 14, respectively. Each of the four hinged end portions 22 facilitates the loading and unloading of automobiles through the freight car 10, particularly when automobiles are circus loaded from one freight car 10 to another. Thus, as can be seen easily with reference to FIGS. 1–3, the hinged end portion 22 at the coupler end 49 of the car unit 14 should be in its raised position while automobiles are being loaded into the cargo well 20 from either an adjacent, coupled freight car, or if freight car 10 is uncoupled, from a ramp or other external device. Similarly, a hinged end portion 22 at the articulated end 51 of the car unit 14 as well as a hinged end portion 22 at the articulated end of the car unit 12 should preferably be raised as automobiles are moved over the body bolsters 50 between the respective cargo wells 20 of each car unit 12 and 14. Finally, a hinged end portion 22 at the coupler end of the car unit 12 should be raised as automobiles are being loaded from the freight car 10 onto an adjacent freight car coupled to freight car 10.

In similar fashion, each of the hinged end portions 22 should be in a lowered position when automobiles 54 are being loaded onto the middle deck 16 from a ramp or from the middle deck of either an adjacent, coupled freight car or adjacent car units 12 and 14 within freight car 10. To facilitate the loading of automobiles 54 between middle decks 16 of either adjacent freight cars or adjacent car units 12 and 14, the hinged end portions 22 may optionally be equipped with bridge units that selectively traverse the distance between adjacent middle decks 16 of either adjacent, coupled freight cars or adjacent car units 12 and 14.

To illustrate one preferred bridge unit 122 suitable for use with the hinged end portion 22 on the coupled end of a freight car 10, FIG. 13 shows two coupled, adjacent freight cars 10, each equipped with a hinged end portion 22 at the coupler end of the freight cars 10, respectively. To facilitate the transfer of automobiles between the middle decks 16 of the freight cars 10, bridge plates 124 may be selectively securable to the hinged end portions 22 so that each bridge plate 124 traverses the gap between the middle decks 16 of the adjacent, coupled freight cars 10. The respective bridge plates 124 should be spaced apart an appropriate distance along the width of the middle decks 16 to provide support for the wheels of automobiles as they are rolled from the middle deck 16 of one freight car 10 to another.

Each bridge plate 124 includes a spring-loaded elongate shaft 126 that may be selectively engaged with brackets 128 and 130 by compressing the ends of the shaft 126 together while aligning the ends of the shaft 126 with gudgeons in the brackets 128 and 130. The shaft 126 is secured to the bridge plate 124 within a centrally positioned sleeve 132 from which the ends of the shaft 126 protrude. The bracket 128 may be attached to the hinged end portion 22 at a fixed location within a cavity 129 while the bracket 130 may be pivotally mounted to the hinged end portion 22 such that it is moveable between an extended position and a retracted position within a cavity 134 defined by the hinged end portion 22. The cavity 129 may be more easily viewed in FIG. 5.

In the configuration shown in FIG. 5, one end of each bridge plate 124 is engaged with the brackets 128 and 130 of the hinged end portion 22 of one of a pair of adjacent freight cars 10. The other end of each bridge plate 124 simply rests on the hinged end portion 22 of the other one of the pair of adjacent freight cars 10. The spring loaded shaft 126 on bridge plate 124 may be selectively engaged with the brackets 128 and 130 associated with the hinged end portion 22 of either of the adjacent, coupled freight cars 10.

The bridge plates 124 that traverse the gap between two adjacent, coupled freight cars 10 may be selectively removed and stored so that the doors of the respective freight cars may be closed while the freight car 10 is moving. With respect to bridge units that traverse the gap between the adjacent, articulated ends 38 and 40 of two rail cars units 12 and 14, however, bridge plates may be permanently affixed to a hinged end portion 22 with no significant disadvantage.

Figure 14:
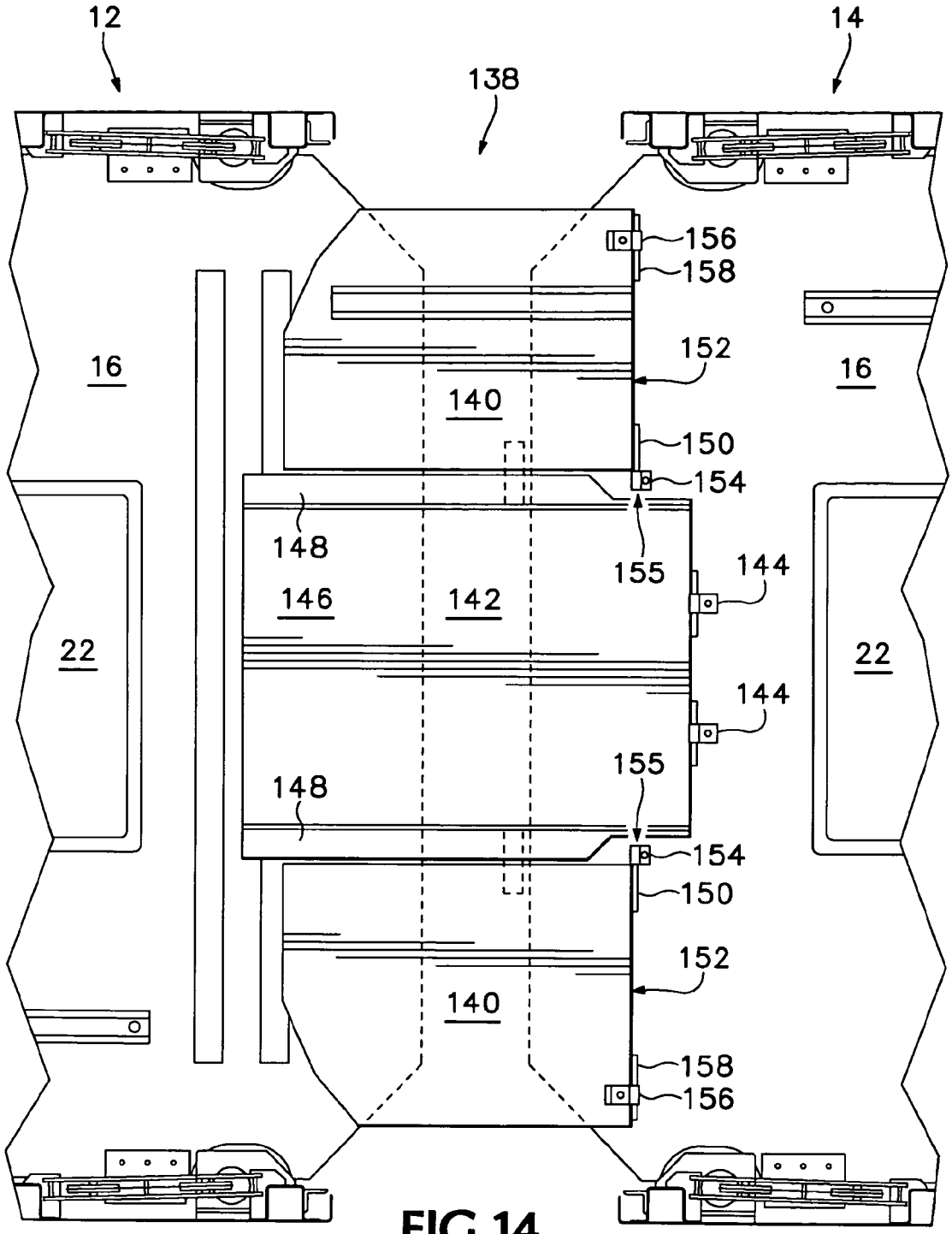
FIG. 14 is a view showing a bridge unit extending between adjacent ends of car units interconnected by an articulated coupling in a freight car that incorporates the present invention.

FIG. 14 shows one preferred bridge unit 138 suitable for use between the articulated ends 38 and 40 of car units 12 and 14. Bridge unit 138 comprises two symmetrically opposite lateral bridge plates 140 located opposite each other alongside a central bridge plate 142. Two fixed hinges 144 pivotally secure the central bridge plate 142 to the hinged end portion 22 of car unit 14. The central bridge plate 142 includes a raised center member 146 and a respective downwardly projecting side member 148 located on each side of the center member 146.

Each of the lateral bridge plates 140 may include a rod 150 affixed to its end 152 at a location near that side of the bridge plate 140 adjacent to the central bridge plate 142. Each rod 150 may be selectively inserted into a sleeve 154 mounted to the hinged end portion 22 of car unit 14. On the end 152 of each lateral bridge plate 140, at a location spaced apart from the rod 150, is a gudgeon 156 that may selectively be engaged with a rod 158 mounted to the hinged end portion 22 of car unit 14. When the rods 150 and the gudgeons 156 are engaged with the sleeves 154 and the rods 158, respectively, each lateral bridge plate 140 may pivot between a first position that traverses the gap between the car units 12 and 14 and a second position where the lateral bridge plates 140 rest entirely on the hinged end portion 22 of car unit 14.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only the claims that follow.

The invention claimed is:

1. In combination with a railroad freight car body having a length, a deck having a selectively raisable end portion comprising a core of low density material and a skin of fiber reinforced plastics adhered to said core, said core having a length oriented along said length of said car body and said end portion having a concave bottom surface, wherein said end portion is movable between a raised position and a lowered position about a horizontal transverse pivot axis located at an inner end of said end portion, and said end portion further including a counterbalance apparatus comprising:

(a) a compression spring supported by said car body;

(b) a direction-changing force transfer device supported by said car body at a position above said end portion;

(c) a first elongate tension-carrying member operatively connected with said end portion and said direction-changing force transfer device; and (d) a second elongate tension carrying member operatively connected with said compression spring and said direction-changing force transfer device so that tension in said first elongate tension carrying member causes tension in said second elongate tension carrying member and tends to compress said compression spring.

2. The combination of claim 1 wherein said direction-changing force transfer device is a sheave.

3. The combination of claim 1 wherein at least one of said first and second elongate tension carrying members is a cable.

4. The combination of claim 1 wherein said direction-changing force transfer device is a pulley and said first and second elongate tension carrying members are respective parts of a single flexible member extending around said pulley from said lightweight end portion to said compression spring.

5. The combination of claim 1 wherein said compression spring is helical, and wherein said counterbalance apparatus includes a guide tube surrounding said compression spring.

6. The combination of claim 5 wherein a portion of said second tension carrying member extends through an interior of said compression spring.

7. The combination of claim 5 wherein said guide tube surrounding said spring has an inner surface of a polymeric resin.

8. The combination of claim 5 wherein said guide tube surrounding said spring is of a polymeric resin.

9. The combination of claim 8 wherein said polymeric resin is UHMW polyethylene.

10. The combination of claim 5 wherein said guide tube is located adjacent an end of said car body and extends vertically along said sidewall of said car body.

11. In combination with a railroad freight car having a body including at least one interior deck having a movable end portion, a counterbalance apparatus comprising:

(a) a compression spring supported by said car body;

(b) a direction-changing force transfer device supported by said car body at a position above said end portion;

(c) a first elongate tension carrying member operatively connected with said end portion and said direction-changing force transfer device; and (d) a second elongate tension carrying member operatively connected with said compression spring and said direction-changing force transfer device such that tension in said first elongate tension carrying member causes tension in said second elongate tension carrying member and said tension in said second elongate tension carrying member tends to compress said compression spring.

12. The combination of claim 11 wherein said direction-changing force transfer device is a pulley and said first and second elongate tension carrying members are respective parts of a single cable extending around said pulley between said end portion and said compression spring.

13. The combination of claim 11 including a second said counterbalance apparatus, each being operatively associated with a respective lateral side of said end portion.

14. The combination of claim 11 wherein said compression spring is a helical spring, and said counterbalance apparatus includes a guide tube surrounding said spring.

15. The combination of claim 14 wherein said guide tube surrounding said spring has an inner surface of polymeric resin.

16. The combination of claim 14 wherein said guide tube surrounding said spring is of a polymeric resin.

17. The combination of claim 16 wherein said polymeric resin is UHMW polyethylene.

18. The combination of claim 14 wherein said guide tube is located adjacent an end of said car body and extends vertically along said sidewall of said car body.

* * * * *